US010443974B2

(12) United States Patent
Finsand

(10) Patent No.: US 10,443,974 B2
(45) **Date of Patent: *Oct. 15, 2019**

(54) CONCEALED CARRY CLIP FOR HANDGUNS

(71) Applicant: Techna Clip, LLC, Idaho Falls, ID (US)

(72) Inventor: Andy Finsand, Idaho Falls, ID (US)

(73) Assignee: Techna Clip, LLC, Idaho Falls, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/248,645

(22) Filed: Jan. 15, 2019

(65) Prior Publication Data

US 2019/0154398 A1 May 23, 2019

Related U.S. Application Data

(63) Continuation of application No. 15/872,896, filed on Jan. 16, 2018, now Pat. No. 10,222,173, which is a continuation of application No. 15/341,889, filed on Nov. 2, 2016, now Pat. No. 9,903,685, which is a continuation of application No. 14/820,538, filed on Aug. 6, 2015, now Pat. No. 9,677,847.

(60) Provisional application No. 62/033,705, filed on Aug. 6, 2014.

(51) Int. Cl.
*F41C 33/00* (2006.01)

(52) U.S. Cl.
CPC ..... *F41C 33/008* (2013.01)

(58) Field of Classification Search
CPC .... F41C 33/008; F41C 33/006; F41C 33/007; F41C 33/08
See application file for complete search history.

(56) References Cited

U.S. PATENT DOCUMENTS 694,969 A 3/1902 Kemp
2,320,450 A * 6/1943 Valenzuela ..... F41C 33/008 224/271
5,630,535 A * 5/1997 Valenti ..... A45F 5/02 224/191

(Continued)

OTHER PUBLICATIONS

A photograph of a hand gun with pocket clip, purportedly taken of Clip Draw product and purportedly shown in Brownell's Catalog as early as 2001.

(Continued)

*Primary Examiner* — Corey N Skurdal
(74) *Attorney, Agent, or Firm* — Travis R. Banta; TechLaw Ventures, PLLC

(57) ABSTRACT

The present disclosure provides an improved concealed carry clip, that attaches with machine screws to the slide rear cover plate, and which has friction features on the clip to facilitate drawing back the slide with the thumb and index finger. In addition, the cover plate can be equipped with projections that reduce shearing forces on the machine screws. A drilled and tapped replacement cover plate is provided with the improved concealed carry clip. Though the improved concealed carry clips have, to date, been designed for Glock®, M&P®, and Springfield Armory® handguns, the concealed carry clips may be adapted for use on other similarly constructed handguns in the future.

60 Claims, 10 Drawing Sheets

(56) References Cited

U.S. PATENT DOCUMENTS

| | | | | |
|---|---|---|---|---|
| 6,155,468 | A * | 12/2000 | Kinnich | F41C 33/008 224/269 |
| 6,726,072 | B2 * | 4/2004 | Rugh | A45F 5/02 224/269 |
| 9,291,413 | B1 * | 3/2016 | Viani | F41A 3/72 |
| D757,198 | S * | 5/2016 | McDole | D22/108 |
| 9,677,847 | B2 | 6/2017 | Finsand | |
| 9,903,685 | B2 | 2/2018 | Finsand | |
| 10,222,173 | B2 | 3/2019 | Finsand | |
| 2012/0198744 | A1 * | 8/2012 | Meller | F41A 3/72 42/90 |
| 2013/0327798 | A1 * | 12/2013 | Lee | F41C 33/008 224/183 |
| 2014/0047753 | A1 * | 2/2014 | Grossman | F41A 3/66 42/72 |
| 2014/0202982 | A1 * | 7/2014 | Willows | A45F 5/021 215/384 |
| 2014/0298703 | A1 * | 10/2014 | Gale | F41C 27/00 42/71.02 |

OTHER PUBLICATIONS

"No-Holster Carry It's the Clipdraw Connection" (LOFGREN) https://web.archive.org/web/20040405021343/http://clipdraw.com:80/charticle.html; Apr. 5, 2004.

"To dumb gun-ignorant liberals: Magazine size" (PAINE) http://airbyrne.blogspot.com/2013/02; Feb. 19, 2013.

A photograph of two hand gun pocket clips on a wooden plank, purportedly taken of Clip Draw products as early as early as 2001.

A photograph of two hand gun pocket clips taken from the rear position shown against a wooden background, purportedly taken of Clip Draw products as early as early as 2001.

A post from the Technaclip Facebook page, https://www.facebook.com/TechnaClip/photos/a.266518553390021/668318023210070/?type=3&theater; Mar. 26, 2014.

A post from the Technaclip Facebook page, https://www.facebook.com/TechnaClip/photos/a.266518553390021/729787003729838/?type=3&theater; Oct. 30, 2014.

Airsoft Forum, post #2963 dated Sep. 23, 2009 http://www.airsoftforum.com/board/topic/54812-in-response-to-show-off-your-rifle-show-off-your-pistol/pGE-75, pp. 1-5.

* cited by examiner

CONCEALED CARRY CLIP FOR HANDGUNS

This application is a continuation of co-pending U.S. patent application Ser. No. 15/872,896, filed Jan. 16, 2018, which is a continuation of U.S. patent application Ser. No. 15/341,889, filed Nov. 2, 2016 (U.S. Pat. No. 9,903,685), which is a continuation of U.S. patent application Ser. No. 14/820,538, filed Aug. 6, 2015 (U.S. Pat. No. 9,677,847), which claims the benefit of U.S. Provisional Application No. 62/033,705, filed Aug. 6, 2014, which are incorporated herein by reference in their entireties, including but not limited to those portions that specifically appear hereinafter, the incorporation by reference being made with the following exception: In the event that any portion of the above-referenced applications are inconsistent with this application, this application supercedes said portion of said above-referenced applications.

BACKGROUND OF THE INVENTION

1. Field of the Invention

This invention relates to the field of firearms, and to handguns in particular. The invention provides a clip which can be used to carry the gun, and which is removable and repositionable so as to allow the clip to be used on a plurality of different guns.

2. History of the Prior Art

There are many circumstances in which there is a legitimate need to carry a concealed weapon. For example, plain-clothes law enforcement officers need to carry firearms in an inconspicuous manner. Also, off-duty officers may need the same capability. But the same person who needs to conceal the weapon at certain times may also want to keep the weapon in a holster at other times, when concealment is not required.

Most modern semi-automatic handguns share common design parameters. FIG. 1 shows a right side view of a handgun 100 manufactured by the Springfield Armory. The model is the XD-S. Like other modern handguns, it has a composite frame 101, which incorporates a hollow handle 102 which receives a multi-cartridge clip 103, and a trigger assembly 104. A slide 105, which moves backward in reaction to each firing, enables the semi-automatic operation. The slide 105 incorporates a barrel 106, a chamber 107, and an ejector 108 which strips spent cartridges and ejects them from the chamber 107. The ejector 108, which pivots on a roll pin 109, swings outwardly as spent cartridges are ejected.

It has been known to attach a clip to a handgun, so as to allow the handgun to be carried near the user's waist, with the clip engaging the user's belt or pants waistband. One example of such a clip is shown in U.S. Pat. No. 6,155,468 to Francis L. Kinnich. A concealed carry clip is disclosed for a semiautomatic pistol, such as a .45 caliber. The clip is attached to the slide stop of the weapon. Size and weight of the clip is minimized so that its effect on the bulk, weight or balance of the weapon is negligible. The clip may be rounded to avoid digging into material it is clipped over. The interior surface may be flat or rounded to provide a snug fit.

Another product, sold under the Clipdraw™ brand, and available from Skyline Toolworks LLC, of Malvern Pa., provides a belt clip for carrying a handgun. The one-piece clip is screwed directly onto the handgun when it is desired to clip the gun to a belt, or removed therefrom when it is desired to carry the handgun in a holster.

A problem with the Clipdraw product described above is that the clip is attached to the handgun with either existing screw holes or new screw holes that are drilled and tapped into the handgun. Few gun owners are willing to drill into the body of a valued handgun.

Clipdraw also provides another type of concealed carry clip that attaches to the rear cover plate of the slide. A drilled and tapped replacement rear cover plate is provided with the clip. After swapping the original rear cover plate for the drilled and tapped replacement cover plate, the clip is screwed to the replacement cover plate. For Glock handguns, a billet drilled and tapped aluminum cover is provided to replace the original composite plastic cover plate. An advantage to this arrangement is that the handgun can be returned to stock condition by substituting the original cover plate for the drilled and tapped replacement cover plate. A disadvantage to this particular Clipdraw product is that it partially covers the right side of the slide so that the machined or molded friction slots at the right rear of the slide—which assist in pulling the slide back with the thumb and index finger—are covered with the clip, which has no friction grooves. Another problem with the design of the clip is that the machine screws that secure the clip to the replacement cover plate may be subjected to shearing forces that can cause the screws to structurally fail.

SUMMARY OF THE INVENTION

The present invention provides an improved concealed carry clip, that attaches with screws to the slide rear cover plate, and which has through-hole friction punchings or stamped protrusions on the clip to facilitate drawing back the slide with the thumb and index finger. In addition, the mounting tab of the clip may fit against one or between two projections that are machined into the rear cover plate. The projections not only reduce shear loads on the machine screws that secure the clip to the rear cover plate, but also prevent the clip from rocking on the securing machine screws. As with the Clipdraw product, a drilled and tapped replacement rear cover plate is provided with the improved concealed carry clip. Though the improved concealed carry clips have, to date, been designed for Glock®, M&P® and Springfield Armory® XD handguns, the concealed carry clips may be adapted for use on other similarly constructed handguns.

DETAILED DESCRIPTION OF THE PREFERRED EMBODIMENT

The invention will now be described with reference to the attached drawing figures. It should be understood that the drawings are not necessarily drawn to scale and are intended to be merely illustrative of the invention.

The present invention provides an improved concealed carry clip, that attaches with screws to the slide rear cover plate and which has a friction punching on the clip to facilitate drawing back the slide with the thumb and index finger. As with the Clipdraw product, a drilled and tapped replacement rear cover plate is provided with the improved concealed carry clip. Certain improvements have been made which distinguish the concealed carry clips of the present invention from those marketed by Clipdraw. Most notably, the clips are equipped with friction enhancing punching or protrusions that facilitate drawing back the slide of the handgun with the thumb and index finger. In addition, certain rear cover plates are equipped with projections that shearing loads on the connecting screws are either eliminated or significantly reduced.

Figure 1:
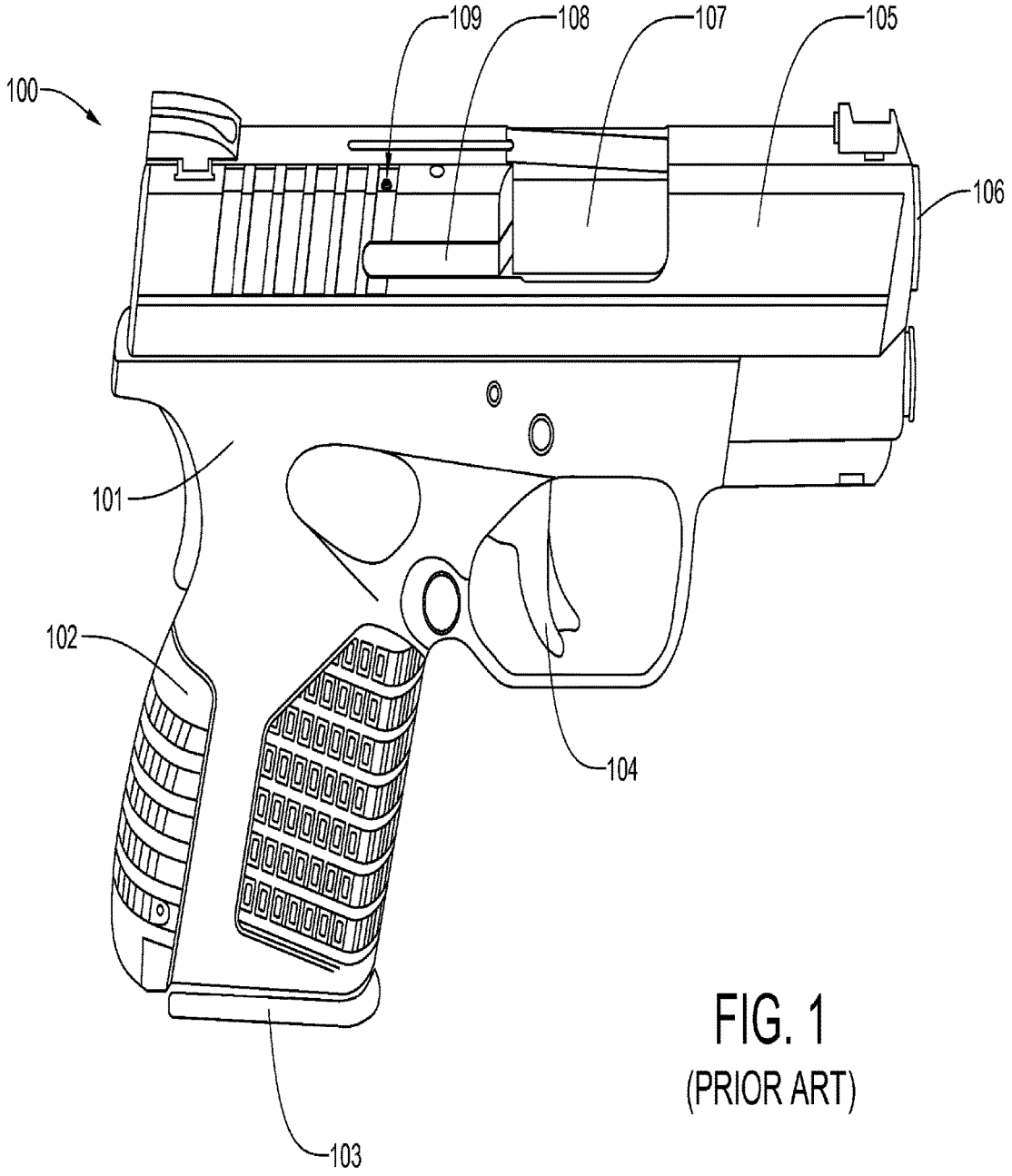
FIG. 1 (PRIOR ART)
FIG. 1 is a side elevational view of a Springfield Armory XD-S handgun.
Figure 2:
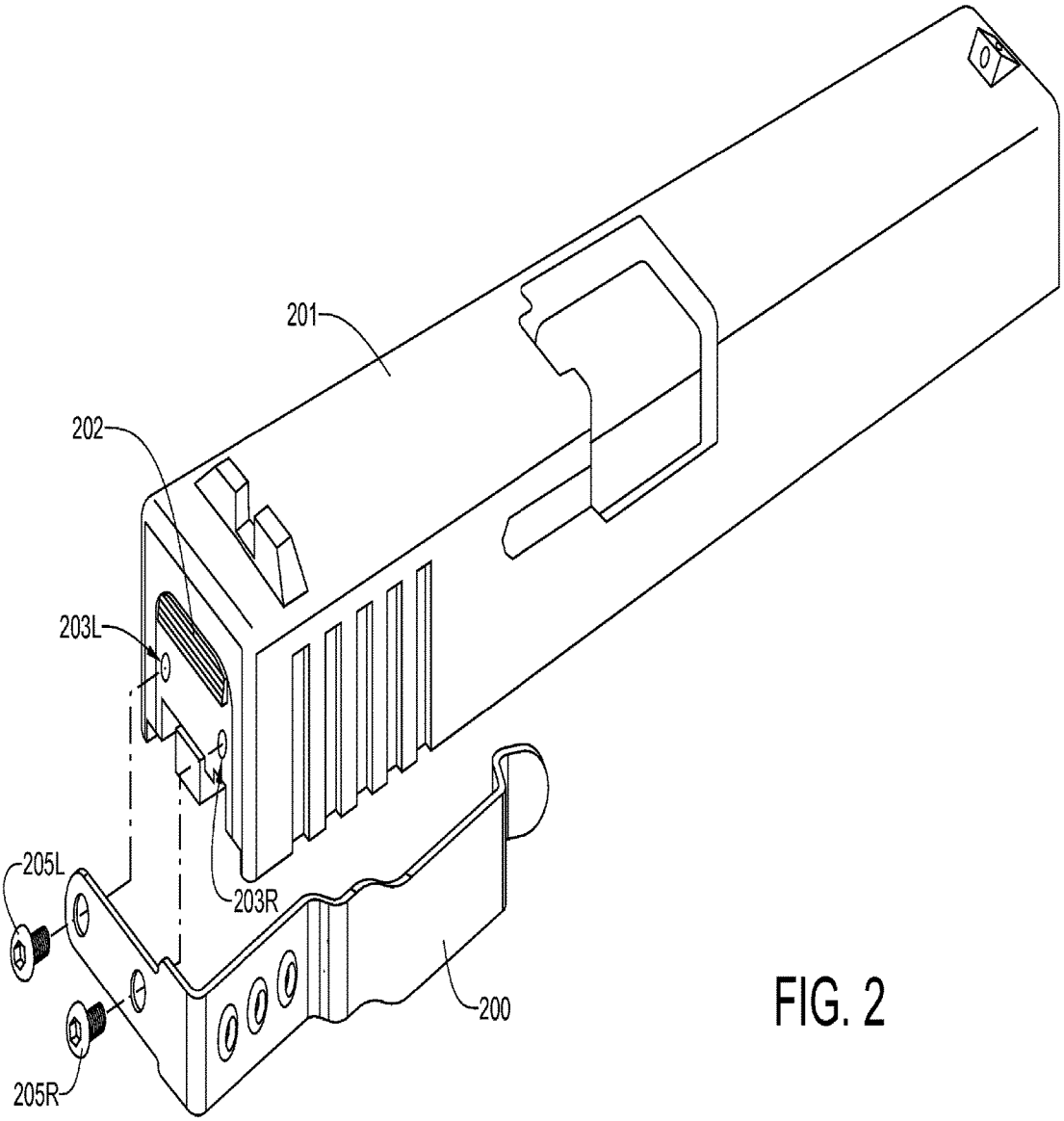
FIG. 2 is a perspective view of the slide of a Glock handgun that has been fitted with a drilled and tapped replacement rear cover plate, with the improved concealed carry clip ready to be secured thereto with a pair of machine screws.

Referring now to FIG. 2, the slide 201 of a Glock 17, 19, 22, 23, 24, 25, 26, 27, 28, 30-S, 31, 32, 33, 34, 35, or 36 handgun has been removed from the receiver, and the original composite rear cover plate has been replaced with an aluminum rear cover plate 202 that has been equipped with threaded screw holes 203L and 203R. The improved concealed carry clip 200 is ready to be secured to the aluminum rear cover plate 102 with a pair of machine screws 105L and 105R.

Figure 3:
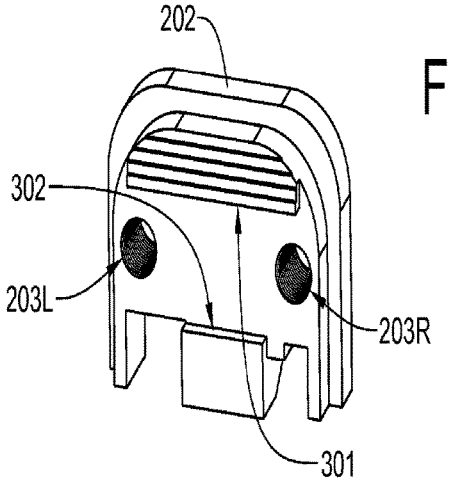
FIG. 3 is an isometric view of a drilled and tapped replacement rear cover plate for the slide of a Glock handgun.

Referring now to FIG. 3, the replacement aluminum rear cover plate 202 for a 17, 19, 22, 23, 24, 25, 26, 27, 28, 30-S, 31, 32, 33, 34, 35, or 36 handgun is shown in greater detail. The cover plate 202 has been equipped with threaded screw holes 203L and 203R. It will be noted that the cover plate 202 is further equipped with an upper projection 301 and a lower projection 302.

Figure 4:
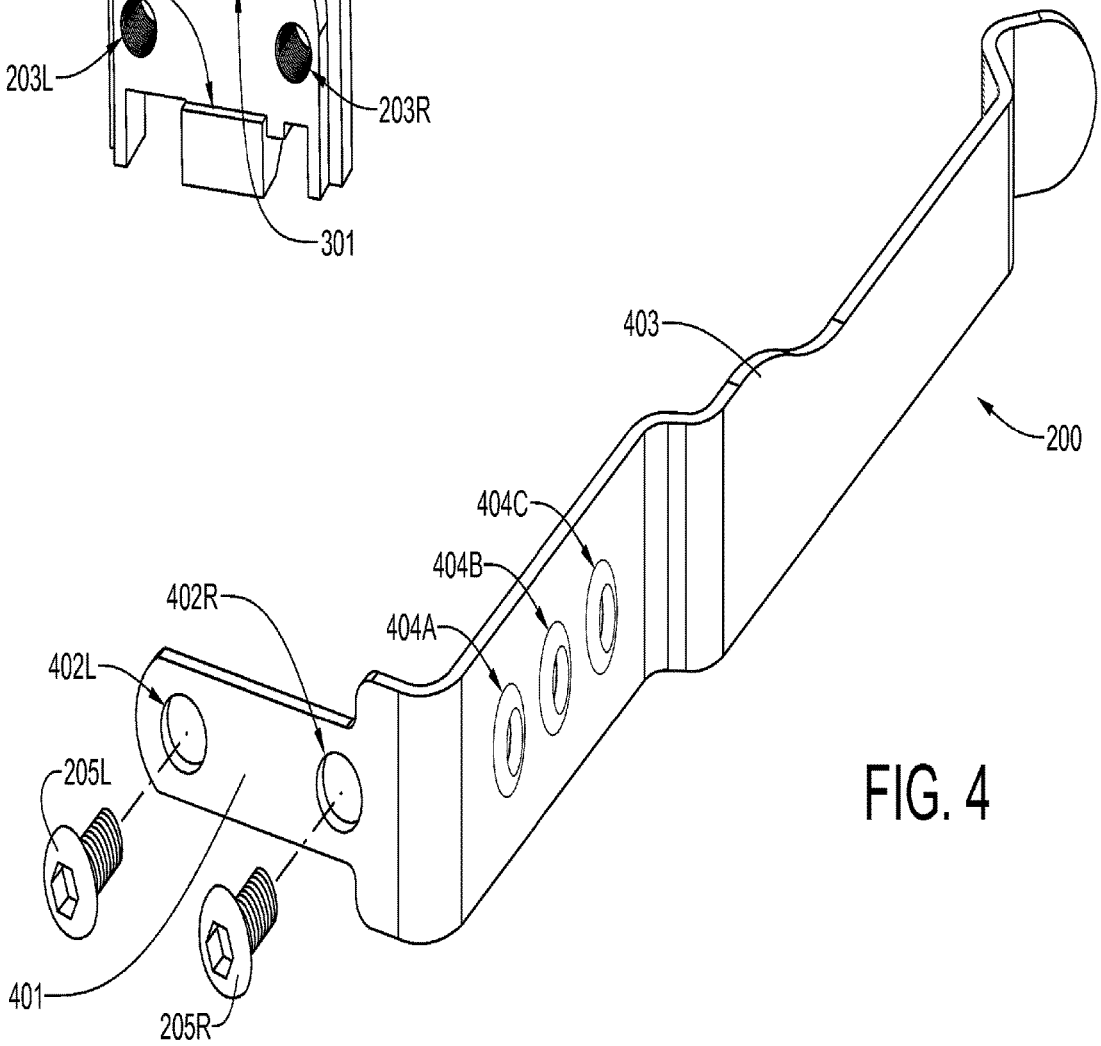
FIG. 4 is an isometric view of an improved concealed carry clip for a Glock handgun.

Referring now to FIG. 4, the improved concealed carry clip 200 for a Glock handgun is shown in greater detail. It will be noted that the concealed carry clip 200 has a mounting tab 401 equipped with two apertures 302L and 302R, by means of which the clip 200 will be attached with machine screws to the replacement aluminum rear cover plate 202. The mounting tab 401 fits snugly between the upper projection 301 and the lower projection 302 of the cover plate 202 so that shearing loads on the securing screws 205L and 205R are eliminated. In addition, the projections also prevent the mounting tab 401 from rocking on the securing machine screws when there is not a tight fit between the apertures 402L and 402R and the screws 205L and 205R, respectively. The rocking motion of the mounting tab 401 on the securing screws 205L and 205R can also be minimized by using shoulder screws so that the screw shoulders, and not threads, are in contact with the apertures 402L and 402R. As threads have very little surface area, the clearance between the threads of the screws near the head tends to increase with use. The concealed carry clip 200 also has a longitudinal clip portion 403 that is generally orthogonal to the mounting tab 401. The clip portion 403 is equipped with three friction through-hole, in-relief punchings 404A, 404B and 404C which facilitate drawing back the slide of the Glock handgun with the thumb and index finger.

Figure 5:
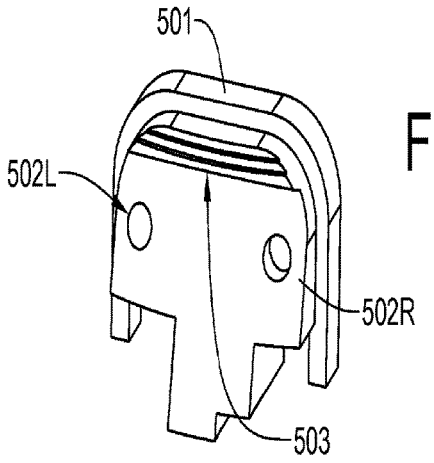
FIG. 5 is an isometric view of a drilled and tapped replacement rear cover plate for the slide of an M&P handgun.

Referring now to FIG. 5, a replacement rear cover plate 501 for the slide of an M&P Smith and Wesson handgun has been equipped with treaded screw holes 502L and 502R. It will be noted that the cover plate 501 is further equipped with an upper projection 503.

Figure 6:
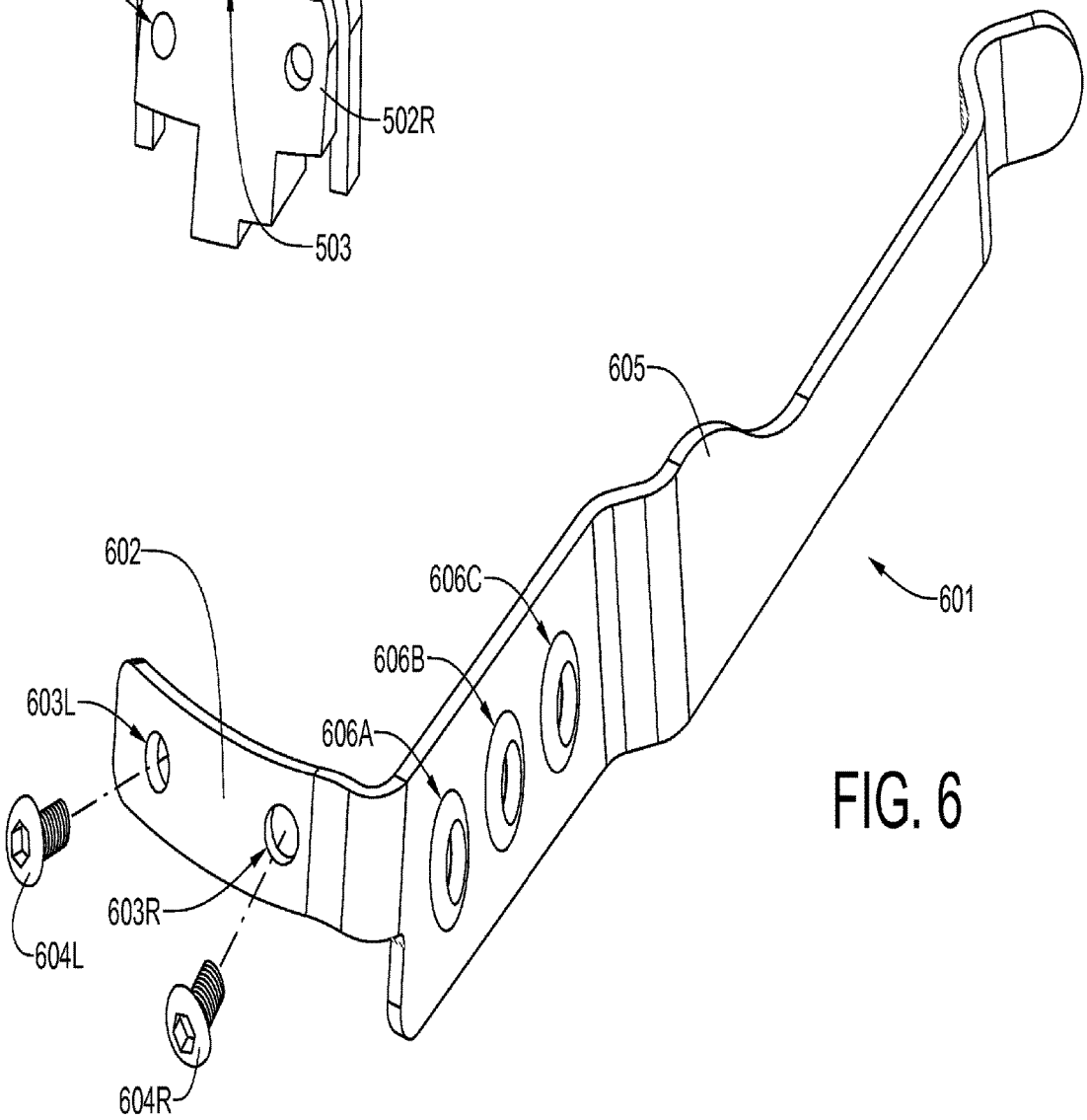
FIG. 6 is an isometric view of an improved concealed carry clip for an M&P handgun.

Referring now to FIG. 6, an improved concealed carry clip 601 for an M&P handgun is equipped with a mounting tab 602 having two apertures 603L and 603R, by means of which the clip 601 will be attached with machine screw 604L and 604R to the replacement aluminum rear cover plate 401. The mounting tab 502 fits snugly against the upper projection 503 so that shearing loads on the securing screws 604L and 604R are reduced. In addition, the projection also limits or prevents any rocking motion of the mounting tab 602 on the securing machine screws 604L and 604R when there is not a tight fit between the apertures 603L and 603R and the screws 604L and 604R, respectively. The clip 601 also has a longitudinal clip portion 605 that is generally orthogonal to the mounting tab 602. The clip portion 605 is equipped with three friction through-hole, in-relief punchings 606A, 606B and 606C, which facilitate drawing back the slide of the M&P handgun with the thumb and index finger.

Figure 7:
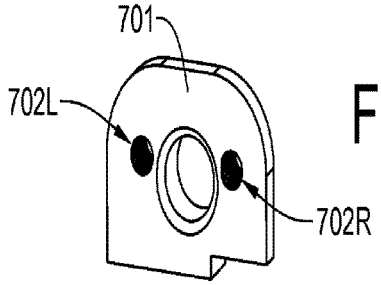
FIG. 7 is an isometric view of a drilled and tapped replacement rear cover plate for the slide of an XD handgun.

Referring now to FIG. 7, a replacement rear cover plate 701 for the slide of an XD handgun has been equipped with threaded screw holes 702L and 702R.

Figure 8:
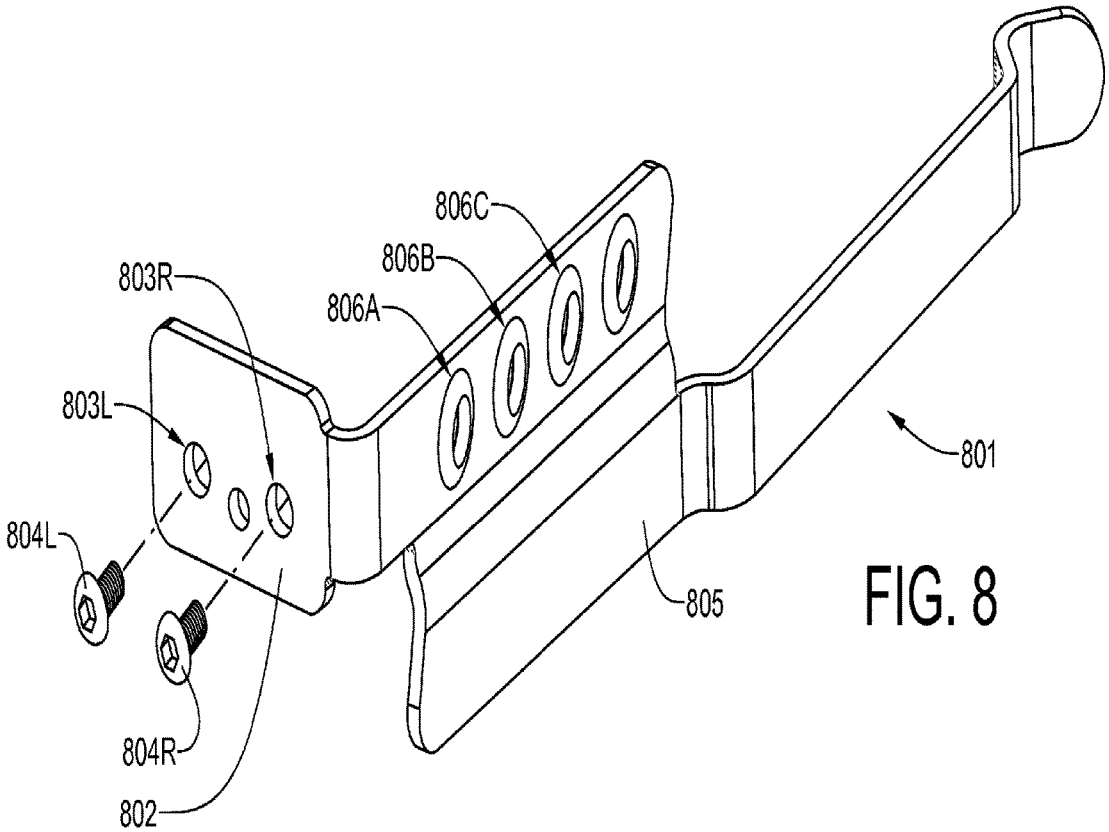
FIG. 8 is an isometric view of an improved concealed carry clip for an XD handgun.

Referring now to FIG. 8, an improved concealed carry clip 801 for an XD handgun is equipped with a mounting tab 802 having two apertures 803L and 803R, by means of which the clip 801 will be attached with machine screws 804L and 804R to the replacement aluminum rear cover plate 701. The concealed carry clip 801 also has a clip portion 805 that is generally orthogonal to the mounting tab 802. The clip portion 805 is equipped with three friction through-hole in-relief punchings 806A, 806B and 806C, which facilitate drawing back the slide of the XD handgun with the thumb and index finger.

Figure 9:
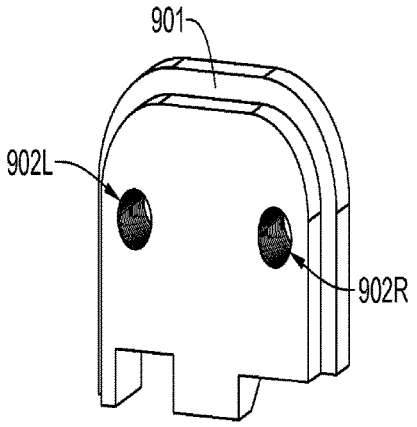
FIG. 9 is an isometric view of a drilled and tapped replacement rear cover plate for the slide of a Glock 42 handgun.

Referring now to FIG. 9, a replacement rear cover plate 901 for the slide of a Glock 42 handgun has been equipped with treaded screw holes 902L and 902R.

Figure 10:
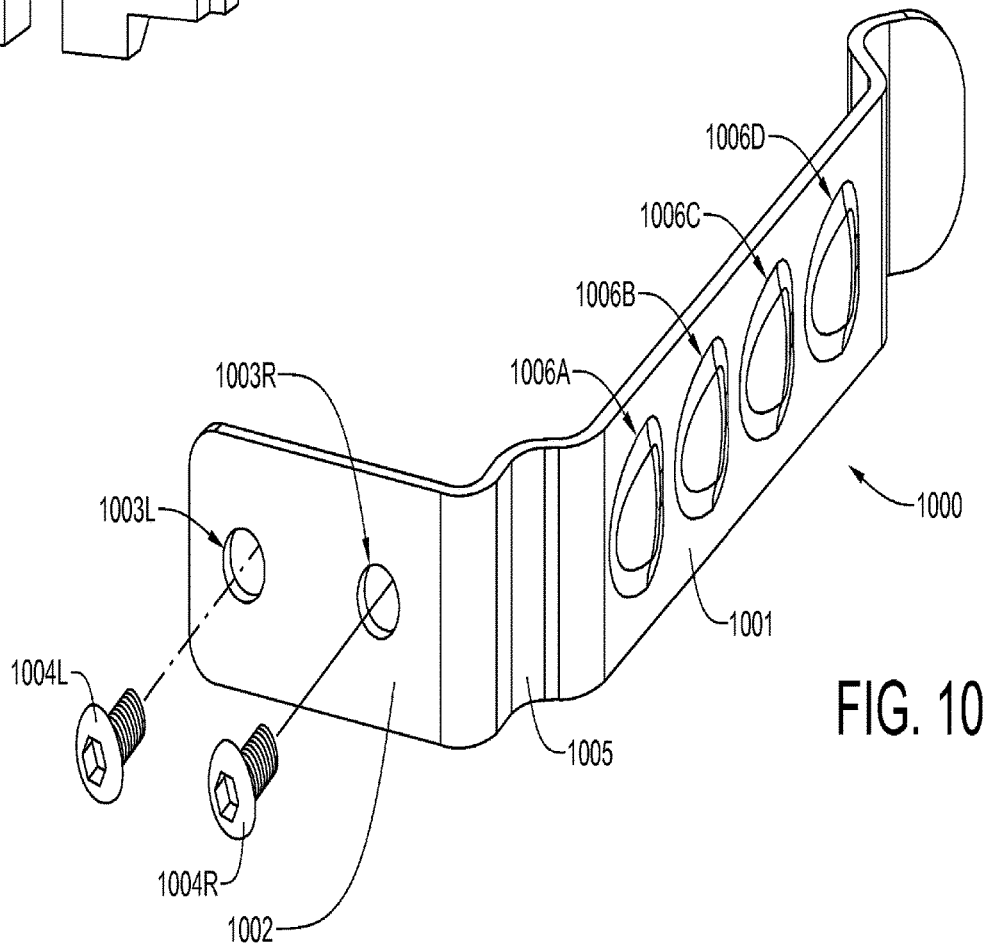
FIG. 10 is an isometric view of an improved concealed carry clip for a Glock 42 handgun.

Referring now to FIG. 10, an improved concealed carry clip 1000 for a Glock 42 handgun is equipped with a mounting tab 1002 having two apertures 1003L and 1003R, by means of which the clip 1000 will be attached with machine screws 1004L and 1004R to the replacement aluminum rear cover plate 901. The concealed carry clip 1000 also has a concave portion 1005 that fits within a recess in the slide of the handgun. A longitudinal clip portion of the concealed carry clip 1001 is generally orthogonal to the mounting tab 1002. The concealed carry clip 1000 is equipped with four stamped protrusions 1006A, 1006B, 1006C and 1006D, which facilitate drawing back the slide of the XD handgun with the thumb and index finger by enhancing grip.

Figure 11:
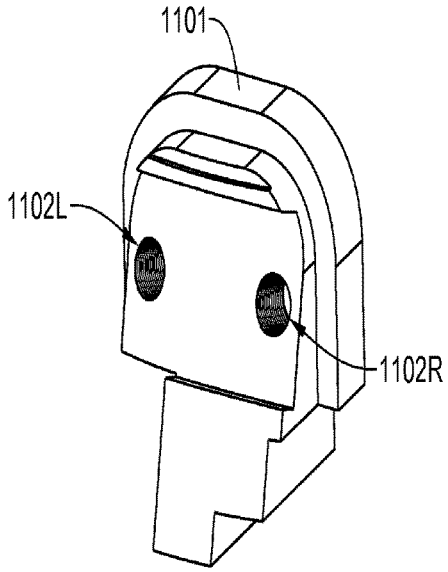
FIG. 11 is an isometric view of a drilled and tapped replacement rear cover plate for the slide of an XD-S handgun.

Referring now to FIG. 11, a replacement rear cover plate 1101 for the slide of a Springfield Armory XD-S handgun has been equipped with treaded screw holes 1102L and 1102R.

Figure 12:
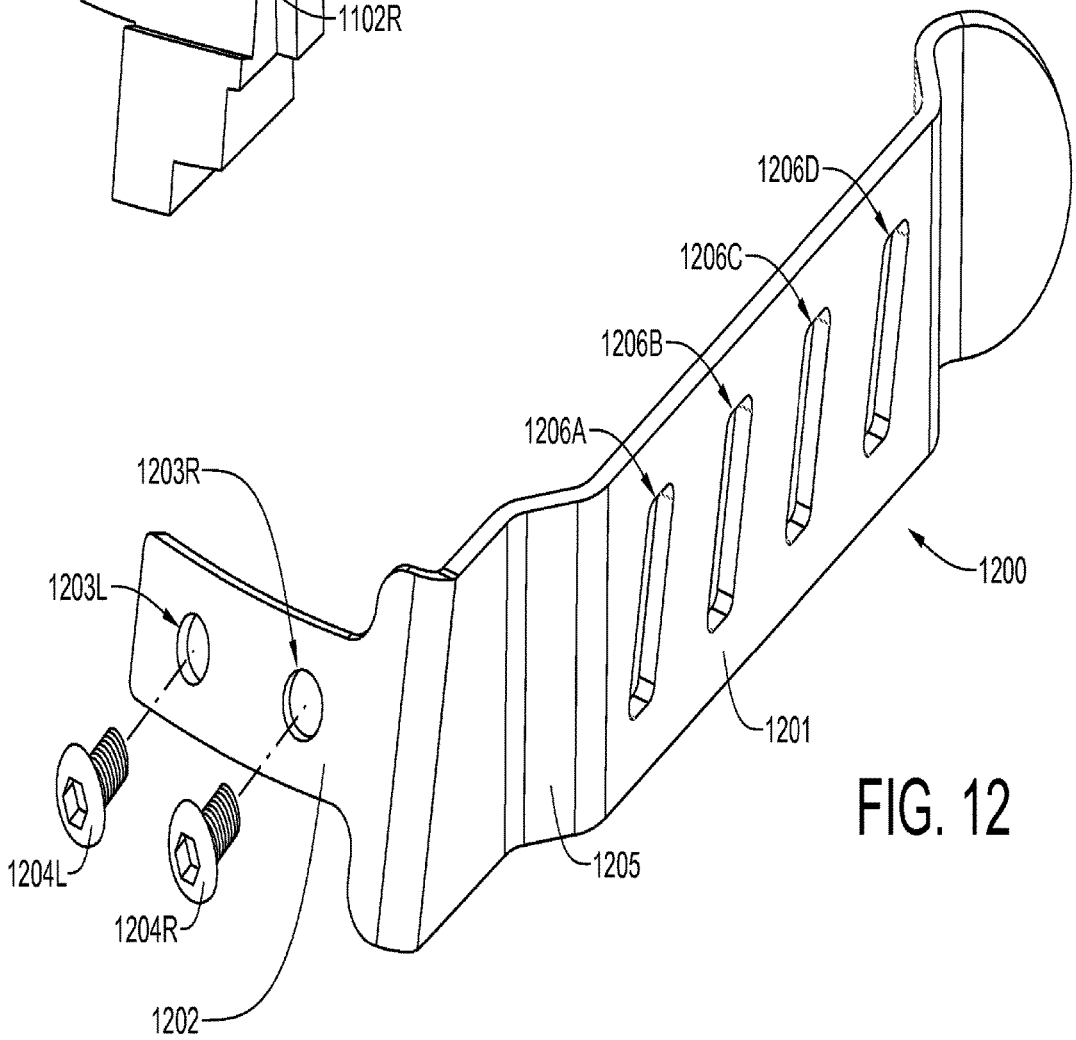
FIG. 12 is an isometric view of an improved concealed carry clip for an XD-S handgun.

Referring now to FIG. 12, an improved concealed carry clip 1200 for an XD-S handgun is equipped with a mounting tab 1202 having two apertures 1203L and 1203R, by means of which the clip 1200 will be attached with machine screws 1204L and 1204R to the replacement aluminum rear cover plate 1101. The concealed carry clip 1200 also has a concave portion 1205 that fits flush against the slide of the handgun before bending out and becoming a longitudinal clip portion 1201, which is spaced from the slide of the XD-S handgun. The longitudinal clip portion 1201 is generally orthogonal to the mounting tab 1202. The concealed carry clip 1200 is equipped with four stamped apertures 1206A, 1206B, 1206C and 1206D, which facilitate drawing back the slide of the XD-S handgun with the thumb and index finger by enhancing grip.

Figure 13:
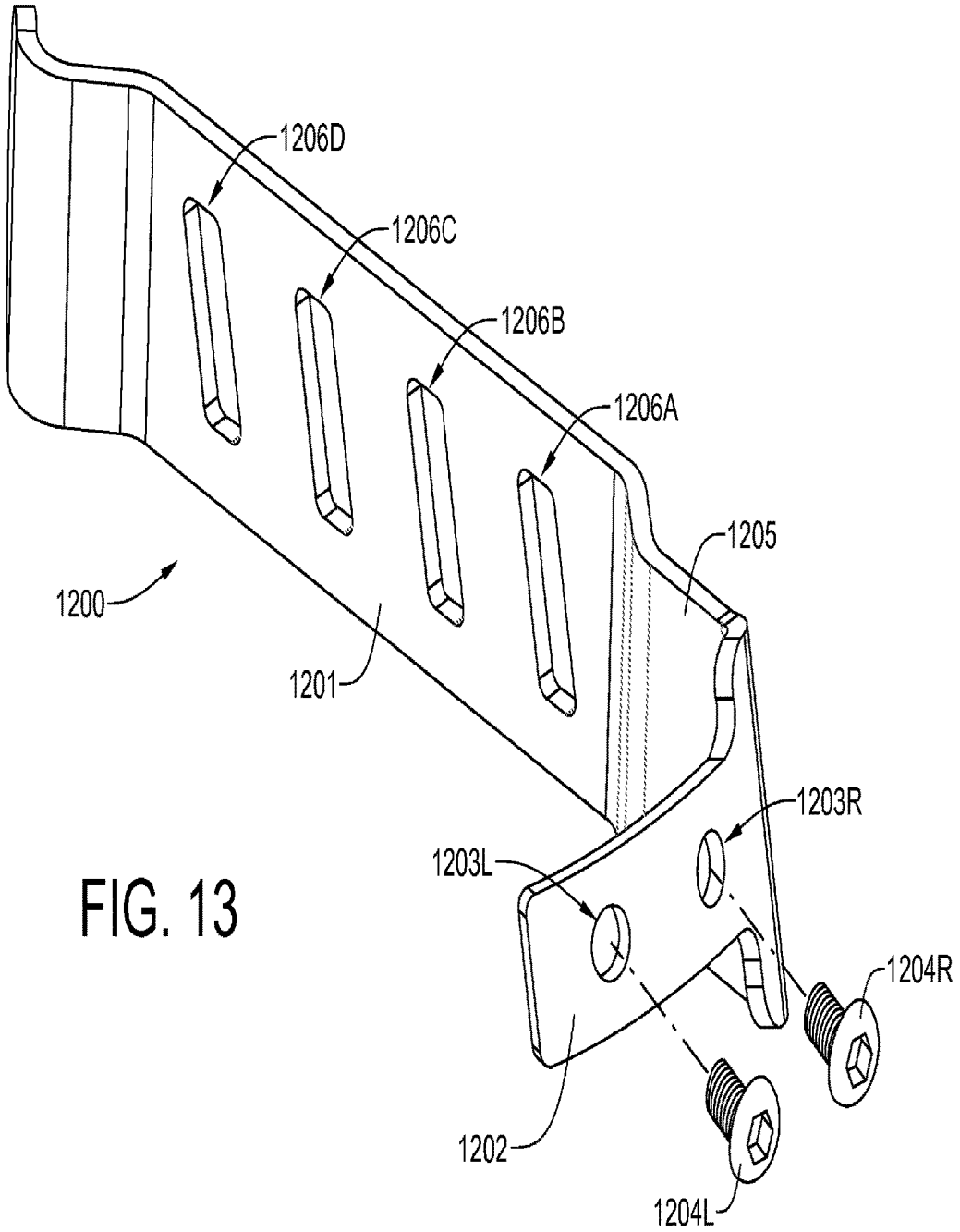
FIG. 13 is an alternative isometric view of the improved concealed carry clip for an XD-S handgun.

Referring now to FIG. 13, the improved concealed carry clip 1200 of FIG. 12 is shown in a different view, in which the inside surface of the longitudinal clip portion 1201 is visible.

Figure 14:
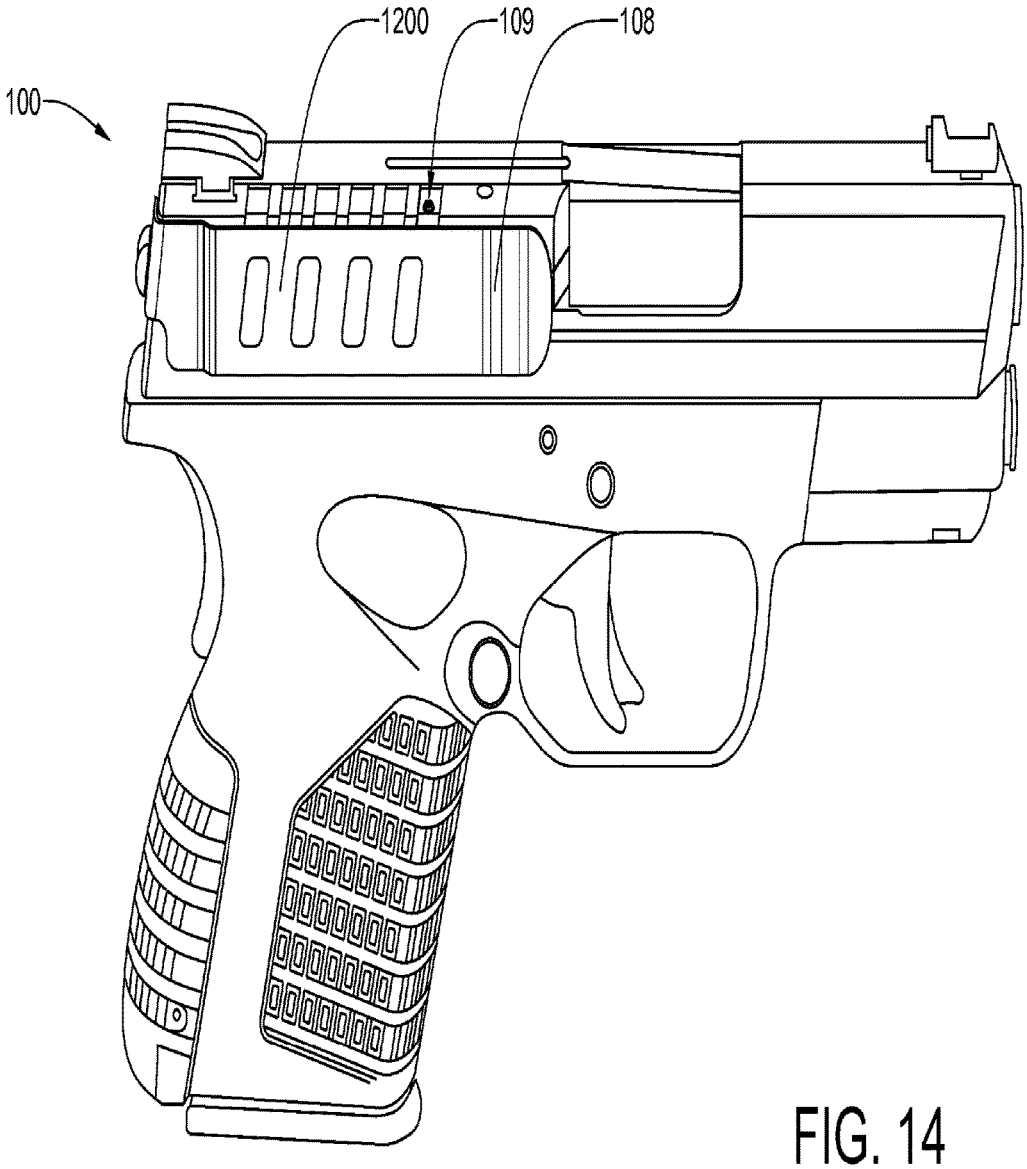
FIG. 14 is a side elevational view of an XD-S handgun with the rear cover plate of FIG. 11 and the concealed carry clip of FIGS. 12 and 13 installed thereon.

Referring now to FIG. 14, the replacement rear cover plate 1101 and the improved concealed carry clip 1200 of FIGS. 12 and 13 have been mounted on a Springfield Armory XD-S handgun. It will be noted that this clip, as is the improved concealed carry clip 10000 of FIG. 10 are both designed to mount behind the chamber of the handgun (item 107, in the case of the XD-S handgun). This feature has two benefits: 1) it enables the handgun to be carried lower on the carrier's body, as only the very rear portion of the handgun—essentially, only that portion of the handgun that is behind the midpoint of the rear sight—is exposed above the belt or waistband of the carrier; 2) The longitudinal portion of the carry clip need not dip below the ejector of the chamber so as not to interfere with the functioning of the handgun when firing.

Figure 15:
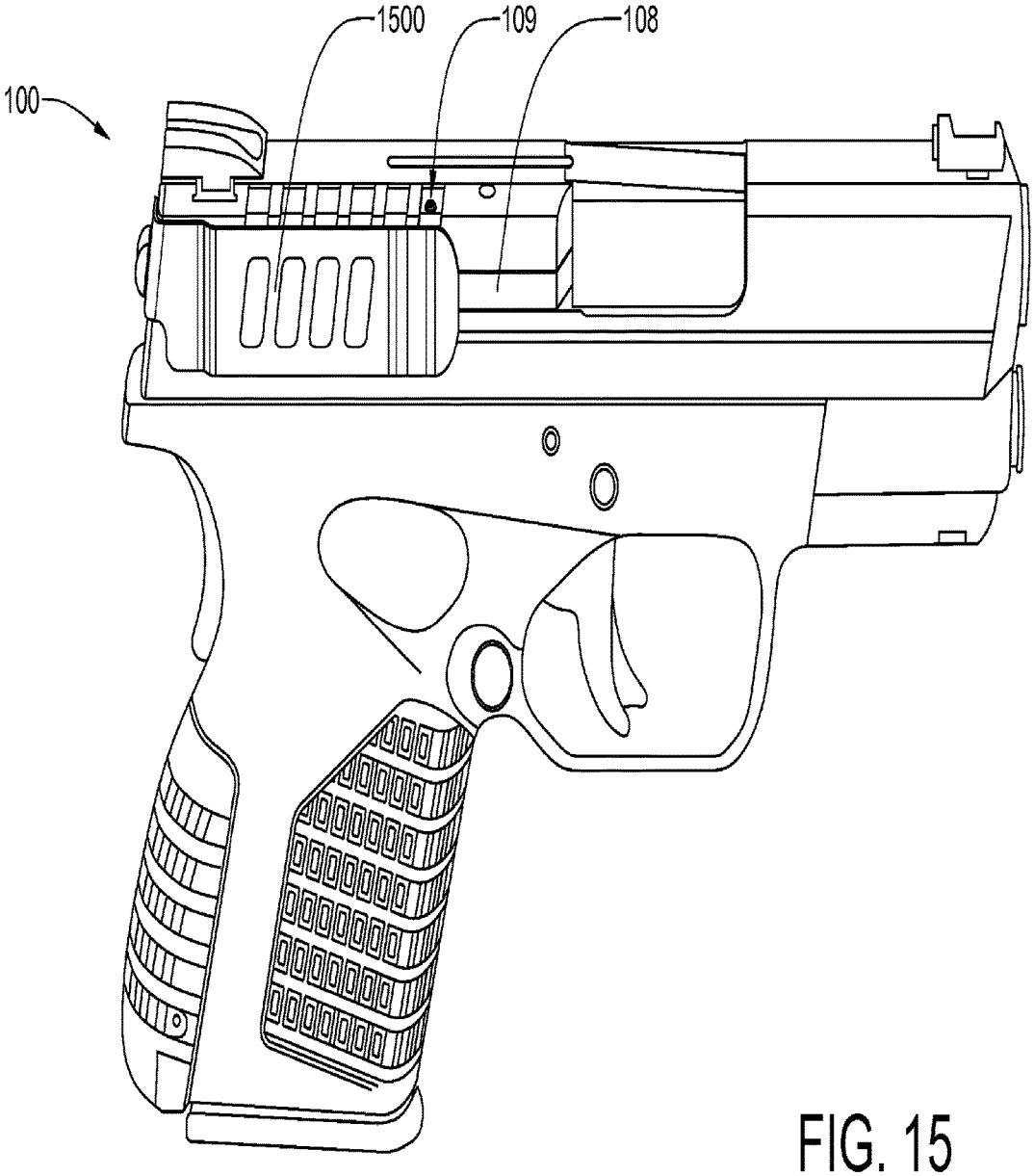
FIG. 15 is a side elevational view of an XD-S handgun with the rear cover plate of FIG. 11 and a shortened version of the concealed carry clip of FIGS. 12 and 13 installed thereon.

Referring now to FIG. 15, a shorter version 1500 of the concealed carry clip 1200 is mounted on the same XD-S handgun. The forward end of concealed carry clip 1500 is about even with the pivot pin 109 of the ejector 108. Thus, when the handgun 100 is fired, the forward end of the clip 1500 need not be pushed aside as spent cartridges are ejected. In the case of concealed carry clip 1200, the clip must be pushed aside by the ejector 108 as spent cartridges are ejected. Although this is deemed to be an acceptable and entirely functional design, the design of the shorter concealed carry clip 1500 is deemed to be the preferred embodiment.

Though the improved concealed carry clips have, to date, been designed for Glock®, M&P® and Springfield Armory® XD handguns, the concealed carry clips may be adapted for use on other similarly constructed handguns. Thus, although only four embodiments of the improved concealed carry clip have been shown and described herein, it will be obvious to those having ordinary skill in the art that changes and modifications may be made thereto without departing from the scope and the spirit of the invention as hereinafter claimed.

What is claimed is:

1. A handgun clip, comprising:

a clip including a clip portion and a mounting tab portion, the mounting tab being securable to a rear slide cover plate of a handgun and being disposed at an angle relative to the clip portion, wherein the clip portion includes a first bend between the mounting tab and a second bend in the clip that creates a space between a handgun slide and the clip, and wherein the clip terminates before a chamber of a handgun.

2. The handgun clip of claim 1, wherein the space created between the handgun slide and the clip accommodates a belt.

3. The handgun clip of claim 1, wherein the space created between the handgun slide and the clip accommodates a waistband.

4. The handgun clip of claim 1, wherein the clip terminates before an ejector pivot pin on the handgun slide.

5. The handgun clip of claim 1, wherein the space created between the handgun slide and the clip terminates at a point where the clip contacts the handgun slide.

6. The handgun clip of claim 1, wherein the clip portion includes one or more projections.

7. The handgun clip of claim 1, wherein the clip portion includes one or more through-hole punchings.

8. The handgun clip of claim 1, wherein the mounting tab includes one or more apertures.

9. The handgun clip of claim 1, wherein the clip includes one or more stamped protrusions.

10. The handgun clip of claim 1, wherein the clip includes one or more through-hole punchings.

11. The handgun clip of claim 1, wherein the angle is a right angle such that the mounting tab is disposed orthogonally to the clip portion.

12. The handgun clip of claim 1, further comprising an end which bends away from the handgun slide.

13. A handgun clip system, comprising:

a clip including a clip portion and a mounting tab portion, the mounting tab being securable to a rear slide cover plate of a handgun and being disposed at an angle relative to the clip portion, wherein the clip portion includes a first bend between the mounting tab and a second bend in the clip that creates a space between a handgun slide and the clip, and wherein the clip terminates before a chamber of a handgun, and a rear slide cover plate.

14. The handgun clip system of claim 13, wherein the rear slide cover plate includes one or more apertures.

15. The handgun clip system of claim 13, wherein the rear slide cover plate includes one or more projections.

16. The handgun clip system of claim 15, wherein one of the one or more projections is positioned on the rear slide cover plate to accept the mounting tab under the one of the one or more projections.

17. The handgun clip system of claim 16, wherein another one of the one or more projections is positioned on the rear slide cover plate to accept the mounting tab over the another one of the one or more projections.

18. The handgun clip system of claim 13, wherein the rear slide cover plate connects to the clip.

19. The handgun clip system of claim 13, wherein the rear slide cover plate is attachable to a handgun slide.

20. The handgun clip system of claim 13, wherein the mounting tab is parallel to the rear slide cover plate.

21. A handgun concealed carry clip, comprising:

a mounting tab;

a clip connectable to the mounting tab and extending along a handgun with a forward end of the clip terminating before a chamber of the handgun, the forward end of the clip including a portion which contacts a slide of the handgun and a portion which flares away from the slide of the handgun at a terminating end of the forward end of the clip, wherein the clip further provides a continuous space disposed between the clip and the handgun between the connection of the clip to the mounting tab and the portion of the forward end of the clip which contacts the slide of the handgun; and a rear slide cover plate connectable to the clip by the mounting tab.

22. The handgun concealed carry clip of claim 21, further comprising friction enhancements along a surface of the clip.

23. The handgun concealed carry clip of claim 22, wherein the friction enhancements include one or more stamped protrusions.

24. The handgun concealed carry clip of claim 22, wherein the friction enhancements include one or more through-hole, in relief punchings.

25. The handgun concealed carry clip of claim 21, further comprising a concave portion disposed adjacent to the mounting tab on the clip.

26. The handgun concealed carry clip of claim 21, further comprising a concave portion disposed between the mounting tab and at least one friction enhancement.

27. The handgun concealed carry clip of claim 21, wherein the mounting tab is secured to the rear slide cover plate by at least one machine screw threaded through at least one aperture in the mounting tab into the rear slide cover plate.

28. The handgun concealed carry clip of claim 21, wherein the rear slide cover plate includes a rear surface disposed to be substantially orthogonal to a slide of the handgun.

29. The handgun concealed carry clip of claim 28, wherein the rear surface disposed to be substantially orthogonal to the slide of the handgun receives the mounting tab of the handgun concealed carry clip.

30. The handgun concealed carry clip of claim 21, wherein the rear slide cover plate includes a rear surface disposed to be at a non-orthogonal angle to a slide of the handgun.

31. The handgun concealed carry clip of claim 21, wherein the rear slide cover plate further includes one or more projections.

32. A rear slide cover plate and a handgun concealed carry clip, comprising:

a rear slide cover plate insertable into a rear portion of a handgun slide, and a handgun concealed carry clip including a clip portion and a mounting tab portion, wherein the rear slide cover plate includes a surface that mates with the mounting tab portion of the handgun concealed carry clip, the mounting tab portion of the handgun concealed carry clip extending substantially across the surface of the rear slide cover plate and there terminating, wherein the surface of the rear slide cover plate is substantially orthogonal to a slide of the handgun and the clip portion of the handgun concealed carry clip.

33. The rear slide cover plate for a handgun of claim 32, further comprising:

a first projection disposed on the rear slide cover plate to abut a first surface of the mounting tab portion of the handgun concealed carry clip.

34. The rear slide cover plate for a handgun of claim 33, further comprising a second projection disposed on the rear slide cover plate to abut a second surface of the mounting tab portion of the handgun concealed carry clip and wherein the first projection and the second projection are disposed on opposite sides of the surface that mates with the mounting tab portion of the handgun concealed carry clip.

35. The rear slide cover plate for a handgun of claim 33, wherein the surface that mates with the mounting tab portion of the handgun concealed carry clip includes one or more apertures.

36. The rear slide cover plate for a handgun of claim 35, wherein at least one of the one or more apertures is threaded.

37. The rear slide cover plate for a handgun of claim 35, wherein at least one of the one or more apertures is unthreaded.

38. A handgun concealed carry clip system, comprising:

a clip including one or more friction enhancements and a mounting tab, wherein the clip extends along the handgun with a forward end terminating before a chamber of the handgun, the forward end of the clip including a portion which contacts a slide of the handgun and a portion which flares away from the slide of the handgun at a terminating end of the forward end of the clip, wherein the clip further provides a continuous space disposed between the clip and the handgun and between the mounting tab and the forward end of the clip which contacts the slide of the handgun, and a rear slide cover plate insertable into the slide of the handgun and including a surface that secures the mounting tab of the clip to the handgun at a substantially orthogonal angle relative to a slide of the handgun.

39. The handgun concealed carry clip system of claim 38, wherein the one or more friction enhancements included in the clip include at least one of a protrusion or a punching.

40. The handgun concealed carry clip system of claim 38, wherein the clip extends along the handgun with a forward end terminating at a point on the slide substantially even with the pivot pin of an ejector of the handgun.

41. A handgun clip, comprising:

a clip, including an integral mounting tab which is connectable to a rear slide cover plate of a handgun slide, the clip extending along the handgun slide with a forward end of the clip terminating before a chamber of the handgun and including one or more through hole punchings along the clip or one or more stamped protrusions along the clip, wherein the clip further includes a concave portion disposed between the mounting tab and a continuous space which is located under the clip and between the concave portion and the forward end of the clip.

42. The handgun clip of claim 41, wherein the mounting tab includes one or more apertures through which the clip is connectable to the rear slide cover plate of the handgun.

43. The handgun clip of claim 41, wherein the mounting tab of the clip is disposed at a right angle to the clip.

44. The handgun clip of claim 41, wherein the forward end of the clip contacts the slide of the handgun at a point before the chamber of the handgun.

45. The handgun clip of claim 44, wherein the forward end of the clip is separated from the concave portion of the clip by a clip portion of the clip.

46. The handgun clip of claim 45, wherein the clip portion of the clip does not physically contact the slide of the handgun.

47. The handgun clip of claim 41, wherein the clip includes both in-relief punchings and stamped protrusions.

48. The handgun clip of claim 41, wherein the one or more stamped protrusions are disposed on the clip between the mounting tab and the forward end of the clip.

49. The handgun clip of claim 41, wherein the one or more through-hole in relief punchings are disposed on the clip between the concave portion of the clip and the forward end of the clip.

50. The handgun clip of claim 41, wherein there are between three and four stamped protrusions disposed on the clip between the concave portion of the clip and the forward end of the clip.

51. The handgun clip of claim 41, wherein there are between three and four through-hole in relief punchings disposed on the clip between the concave portion of the clip and the forward end of the clip.

52. The handgun clip of claim 41, wherein the forward end of the clip comes into contact with the slide of the handgun and is thereafter bent in a direction away from the slide of the handgun.

53. The handgun clip of claim 41, wherein the forward end of the clip terminates at a pivot pin of an ejector along the slide of the handgun.

54. A system, comprising:

a rear slide cover plate insertable into a handgun slide, and a clip, including an integral mounting tab which connects to the rear slide cover plate of a handgun, the clip extending along the handgun slide with a forward end of the clip terminating before a chamber of the handgun and including one or more through hole punchings along the clip or one or more stamped protrusions along the clip, wherein the clip further includes a concave portion disposed between the mounting tab and a continuous space which is located under the clip and between the concave portion and the forward end of the clip.

55. The system of claim 54, wherein the forward end of the clip contacts the slide of the handgun at a point before the chamber of the handgun.

56. The system of claim 54, wherein the forward end of the clip is separated from the concave portion of the clip by a clip portion of the clip.

57. The system of claim 56, wherein the clip portion of the clip does not physically contact the slide of the handgun.

58. The system of claim 54, wherein the integral mounting tab includes two apertures corresponding to two apertures in the rear slide cover plate of the handgun.

59. The system of claim 58, wherein the integral mounting tab is connected to the rear slide cover plate of the handgun by two screws which are each disposed through one of two apertures included in the mounting tab and into one of the two apertures in the rear slide cover plate of the handgun.

60. The system of claim 54, wherein the integral mounting tab is connected to the rear slide cover plate between an upper projection on the rear slide cover plate and a lower projection on the rear slide cover plate.

* * * * *